US011319771B2

(12) United States Patent
Al-Malki et al.

(10) Patent No.: US 11,319,771 B2
(45) Date of Patent: May 3, 2022

(54) CEMENTING HIGH-LOSS ZONES

(71) Applicant: Saudi Arabian Oil Company, Dhahran (SA)

(72) Inventors: Bandar S. Al-Malki, Dammam (SA); Asim Alkhuwayr, Dammam (SA); Ismail Adebiyi, Dhahran (SA); Yousef H. Dahnem, Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 64 days.

(21) Appl. No.: 16/863,669

(22) Filed: Apr. 30, 2020

(65) Prior Publication Data

US 2021/0340840 A1 Nov. 4, 2021

(51) Int. Cl.
*E21B 33/16* (2006.01)
*E21B 33/12* (2006.01)

(52) U.S. Cl.
CPC ..... *E21B 33/16* (2013.01); *E21B 33/1204* (2013.01)

(58) Field of Classification Search
CPC ..... E21B 33/146; E21B 33/16; E21B 33/165; E21B 33/167; E21B 33/138; E21B 33/1204; E21B 17/1028; E21B 27/02; E21B 17/10; E21B 17/1021; E21B 17/1078; E21B 33/05
See application file for complete search history.

(56) References Cited

U.S. PATENT DOCUMENTS

| | | | | |
|---|---|---|---|---|
| 1,898,074 | A * | 2/1933 | Bailey | E21B 17/1021 175/325.7 |
| 2,305,062 | A | 12/1942 | Church et al. | |
| 2,344,120 | A | 3/1944 | Baker | |
| 3,543,144 | A * | 11/1970 | Walters | E21B 47/092 324/221 |
| 4,759,408 | A * | 7/1988 | Buchanan | E21B 33/138 166/278 |
| 8,714,259 | B2 | 5/2014 | Orban | |
| 2004/0149431 | A1* | 8/2004 | Wylie | E21B 33/138 166/242.1 |
| 2010/0096131 | A1* | 4/2010 | Hill | E21B 33/16 166/285 |

(Continued)

FOREIGN PATENT DOCUMENTS

WO WO 9712116 4/1997

OTHER PUBLICATIONS

PCT Invitation to Pay Additional Fees and, where applicable, Protest Fee in International Appln. No. PCT/US2021/029894, dated Aug. 26, 2021, 12 pages.

(Continued)

*Primary Examiner* — David Carroll
(74) *Attorney, Agent, or Firm* — Fish & Richardson P.C.

(57) ABSTRACT

A non-metallic tubular defines a central flow passage. Actuable rollers are actuable between an extended position and a retracted position. The actuable rollers are pivotally attached to the non-metallic tubular. The actuable rollers centralize the non-metallic tubular when in the extended position. The actuable rollers extend between the non-metallic tubular to an inner surface of the wellbore when in the extended position. A connector is attached to an uphole end of the non-metallic tubular. The connector is configured to attach to a downhole end of a work string.

15 Claims, 5 Drawing Sheets

(56) References Cited

U.S. PATENT DOCUMENTS

| | | | | |
|---|---|---|---|---|
| 2013/0008671 | A1 | 1/2013 | Booth | |
| 2015/0152704 | A1* | 6/2015 | Tunget | E21B 17/1078 166/254.2 |

OTHER PUBLICATIONS

PCT International Search Report and Written Opinion in International Appln. No. PCT/US2021/029894, dated Oct. 21, 2021, 18 pages.

PCT International Search Report and Written Opinion in International Appln. No. PCT/US2021/029894, dated Oct. 20, 2021, 18 pages.

* cited by examiner

CEMENTING HIGH-LOSS ZONES

TECHNICAL FIELD

This disclosure relates to wellbore interventions.

BACKGROUND

When drilling a wellbore, drilling operators can come across high-loss zones. A high-loss zone within a wellbore results in a loss of drilling fluid and a reduction of static head that can be used to keep a wellbore under control during drilling operations. High-loss zones are often treated with loss control material to reduce or stop the loss rate of drilling fluid. In other instances, the high-loss zone is plugged with cement, and then the cement plug is drilled through. Both mitigations seal the wellbore from fluid losses into the high-loss zone so that drilling can continue without the risks associated with lost drilling fluid. Cement plugs can be used for other operations as well, for example, plugging and abandoning a well.

SUMMARY

This disclosure describes technologies relating to cementing high-loss zones within a wellbore.

An example implementation of the subject matter described herein is a wellbore tool with the following features. A non-metallic tubular defines a central flow passage. Actuable rollers are actuable between an extended position and a retracted position. The actuable rollers are pivotally attached to the non-metallic tubular. The actuable rollers centralize the non-metallic tubular when in the extended position. The actuable rollers extend between the non-metallic tubular to an inner surface of the wellbore when in the extended position. A connector is attached to an uphole end of the non-metallic tubular. The connector is configured to attach to a downhole end of a work string.

Aspects of the example wellbore tool, which can be combined with the example wellbore tool alone or in combination, include the following. The non-metallic tubular comprises a plastic.

Aspects of the example wellbore tool, which can be combined with the example wellbore tool alone or in combination, include the following. The wellbore tool further includes an actuator to actuate the actuable rollers between the extended position and the retracted position.

Aspects of the example wellbore tool, which can be combined with the example wellbore tool alone or in combination, include the following. The actuator comprises a ball seat trigger.

Aspects of the example wellbore tool, which can be combined with the example wellbore tool alone or in combination, include the following. The connector or the non-metallic tubular have a lower yield strength than the work string.

An example implementation of the subject matter described herein is a method with the following features. A non-metallic tubular is received by a wellbore. Cement is received by central flow passage of the non-metallic tubular. The cement is emitted from a downhole end of the non-metallic tubular. A cement plug is formed from the emitted cement to plug a high loss zone by the cement or to spot a conventional cement plug.

Aspects of the example method, which can be combined with the example method alone or in combination, include the following. The cement plug flash-sets. The non-metallic tubular is retained within the cement plug.

Aspects of the example method, which can be combined with the example method alone or in combination, include the following. A metallic work string uphole of and attached to the non-metallic tubular is rotated. The non-metallic tubular, or a connector retaining the non-metallic tubular to the work string, is sheared responsive to rotating the metallic work string. The metallic work string is retracted from the wellbore. The non-metallic tubular is left within the wellbore.

Aspects of the example method, which can be combined with the example method alone or in combination, include the following. The cement plug is drilled through and the non-metallic tubular that remains within the wellbore.

Aspects of the example method, which can be combined with the example method alone or in combination, include the following. The non-metallic tubular is removed from the wellbore.

Aspects of the example method, which can be combined with the example method alone or in combination, include the following. The non-metallic tubular is received by a second wellbore different from the wellbore.

Aspects of the example method, which can be combined with the example method alone or in combination, include the following. The non-metallic tubular is centralized by actuable rollers.

Aspects of the example method, which can be combined with the example method alone or in combination, include the following. Centralizing the non-metallic tubular includes actuating the actuable rollers by circulating a ball within the non-metallic tubular.

Aspects of the example method, which can be combined with the example method alone or in combination, include the following. Actuating the actuable rollers includes actuating between an extended position and a retracted position, the actuable rollers centralizing the non-metallic tubular when in the extended position.

An example implementation of the subject matter described herein is a well system with the following features. A non-metallic tubular defines a central flow passage. Actuable rollers are actuable between an extended position and a retracted position. The actuable roller is pivotally attached to the non-metallic tubular. The actuable rollers extend between the non-metallic tubular to an inner surface of the wellbore when in the extended position. A connector is attached to an uphole end of the non-metallic tubular. The connector is configured to attach to a downhole end of a metallic work string.

Aspects of the example well system, which can be combined with the example well system alone or in combination, include the following. The non-metallic tubular includes a plastic.

Aspects of the example well system, which can be combined with the example well system alone or in combination, include the following. An actuator actuates the actuable rollers between the extended position and the retracted position.

Aspects of the example well system, which can be combined with the example well system alone or in combination, include the following. The actuator comprises a ball seat trigger.

Aspects of the example well system, which can be combined with the example well system alone or in combination, include the following. The non-metallic tubular is configured to be removed from the metallic work string by torsional shearing.

Aspects of the example well system, which can be combined with the example well system alone or in combination, include the following. The non-metallic tubular and the actuable rollers are configured to be drilled out of a wellbore when the non-metallic tubular becomes stuck in a wellbore.

Aspects of the example well system, which can be combined with the example well system alone or in combination, include the following. The metallic work string comprises coiled tubing.

Particular implementations of the subject matter described in this disclosure can be implemented so as to realize one or more of the following advantages. The tool described herein can be re-used multiple times. In the event that the tool becomes stuck, it is constructed of easily drillable materials.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

In instances where it is advantageous to use a cement plug to mitigate a high-loss zone during drilling, a work string is inserted into the wellbore to a depth proximal to the high-loss zone. In some instances, the work string is retained within the cement, such as when the cement "flash sets". That is, when the cement cures faster than expected, securing and retaining a portion of the work string within the wellbore. In such situations, the work string must be slowly milled out of the wellbore before the plug can be drilled through. Such an operation requires specialized equipment and adds substantially more time to drilling operations. Instances where the high-loss zone is within a horizontal or deviated wellbore, can increase the likelihood of the work string becoming stuck as the downhole end of the work string is more likely to impact the walls of the wellbore in such situations.

This disclosure relates to a non-metallic tubular at the downhole end of a work string. The tubular includes actuable rollers to centralize and at least partially protect the non-metallic tubular from breakage. The tubular is used to form drillable cement plugs to block lost circulation zones or to spot a conventional cement plug. The tubular, rollers, and actuation mechanisms are made of drillable materials. In operation, a cement plug is formed using the non-metallic tubular. In some instances, the non-metallic tubular becomes stuck within the cement plug due to flash settings. In such instances, the non-metallic tubular is then sheared from the work string by over pull or rotation of the work string. The non-metallic tubular is then left within the cement plug to be drilled out at a later time in case of lost in hole due to stuck pipe event, such as a flash-set.

Figure 1:
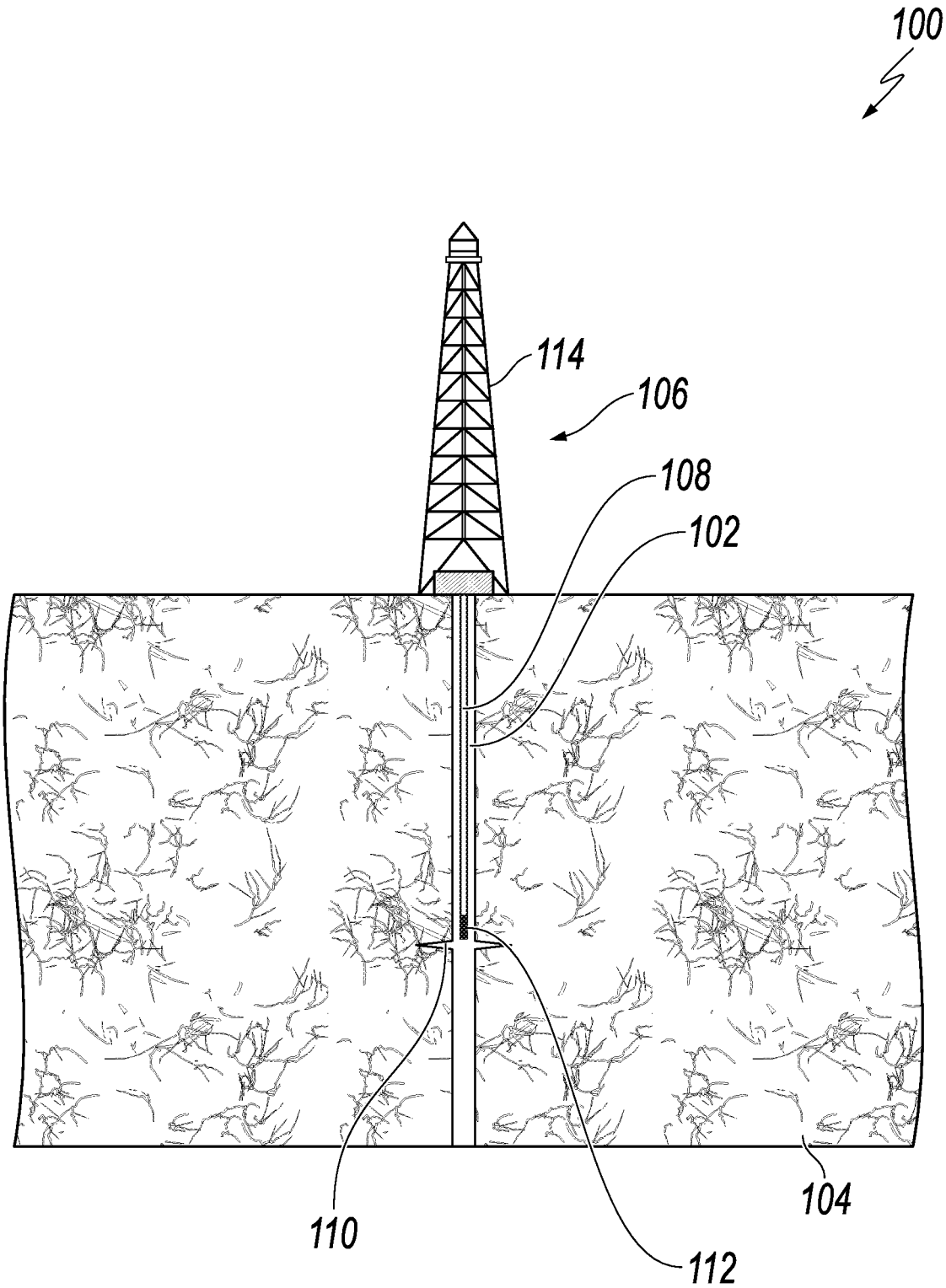
FIG. 1 is a side cross-sectional view of an example wellbore system.

FIG. 1 is a side cross-sectional view of an example wellbore system 100. The wellbore system 100 includes a wellbore 102 formed within a geologic formation 104. As illustrated, a metallic work string 108 is positioned within the wellbore 102 and is supported by a drill derrick 114. The metallic and the wellbore 102 are fluidically connected to and controlled via or by a topside facility 106. At a downhole end of the metallic work string 108 is a wellbore tool 112. As shown, the wellbore tool 112 is positioned by the metallic work string 108 to be proximal to a high-loss zone 110 or cement plug depth. While illustrated with the drill derrick 114, other surface equipment can be used. For example, drilling and workover operations can each use coiled tubing for the operations described herein. While the wellbore 102 is illustrated as a vertical wellbore for clarity, the concepts described herein are equally applicable to horizontal and deviated wellbores.

Figure 2B:
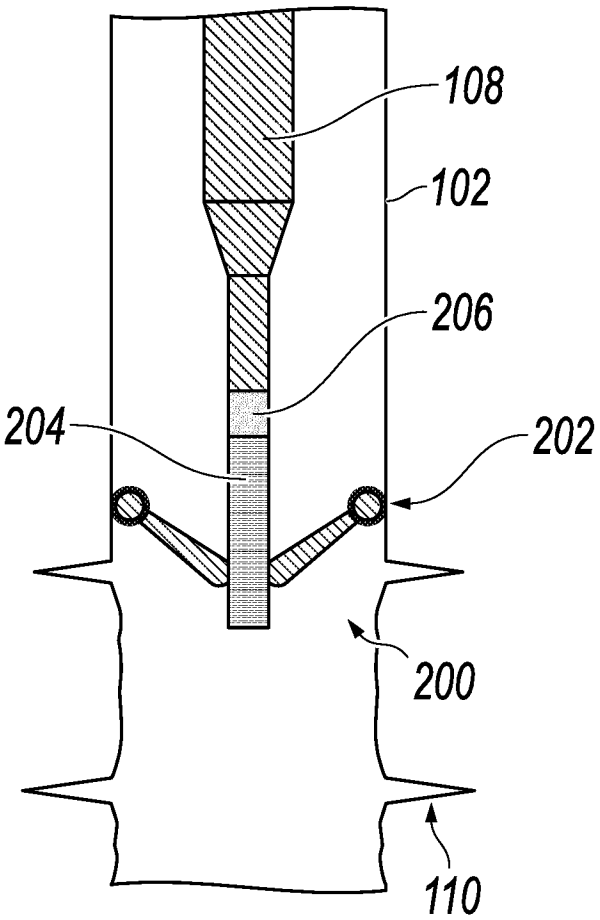
FIG. 2B is a side view of an example wellbore tool positioned within a wellbore with rollers in an extended position.
Figure 2A:
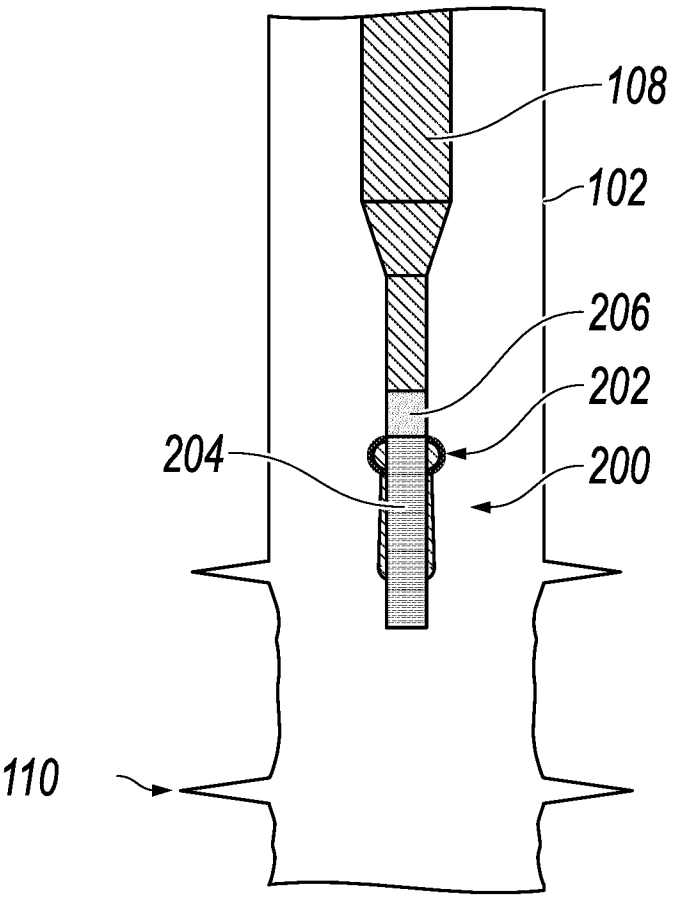
FIG. 2A is a side view of an example wellbore tool positioned within a wellbore with rollers in a retracted position.

FIG. 2A is a side view of an example wellbore tool 200 positioned within a wellbore with actuable rollers 202 in a retracted position. FIG. 2B is a side view of the example wellbore tool 200 positioned within a wellbore with actuable rollers 202 in an extended position. The wellbore tool 200 can be used in place of wellbore tool 112 that has been previously described. The wellbore tool 200 includes a non-metallic tubular 204 that defines a central flow passage. The central flow passage is fluidically connected to a fluid source at the topside facility 106, and directs a fluid flow through the non-metallic tubular 204. The non-metallic tubular 204 is made from a drillable material, such as plastic. Other non-metallic materials can be used as well, such as polyvinyl chloride (PVC), composites, or both.

A connector 206 is attached to an uphole end of the non-metallic tubular 204. The connector 206 is configured to attach to a downhole end of the metallic work string 108. That is, when in use, the connector 206 is between the non-metallic tubular 204 and the metallic work string 108. The connector 206 can connect to the metallic work string 108 and the non-metallic tubular 204 in a variety of ways, for example, a threaded connection, a keyed friction connection, or any other connection that is appropriate for the service. In general, through material properties, geometry, or both, the connector 206, the non-metallic tubular 204, or both, have a lower yield strength than the metallic work string 108. In other words, the non-metallic tubular 204 or the connector 206 will shear away from the metallic work string 108 if sufficient torsional shear (twisting) or tension (pulling) is applied in the event that the non-metallic tubular 204 becomes stuck.

The wellbore tool also includes actuable rollers 202. The actuable rollers 202 are actuable between an extended position (shown in FIG. 2B) and a retracted position (shown in FIG. 2A). As illustrated, the actuable rollers 202 are pivotally attached to the non-metallic tubular 204. When in the extended position, the actuable rollers 202 extend between the non-metallic tubular 204 to an inner surface of the wellbore 102. Such an arrangement allows the actuable rollers 202 to centralize the non-metallic tubular 204 when the actuable rollers are in the extended position. Such centralization reduces the likelihood of the non-metallic tubular impacting the interior wall of the wellbore 102. This centralization is especially helpful in horizontal or deviated wellbores. The rollers also help mitigate the decreased weight (and decreased motive force) caused by having a non-metallic component at the end of the metallic work string 108. When in the retracted position, the actuable rollers 202 can be at least partially recessed within the non-metallic tubular 204.

The wellbore tool 200 includes an actuator to actuate the actuable rollers 202 between the extended position and the retracted position. Components of an example actuator are described later within this disclosure.

Figure 3:
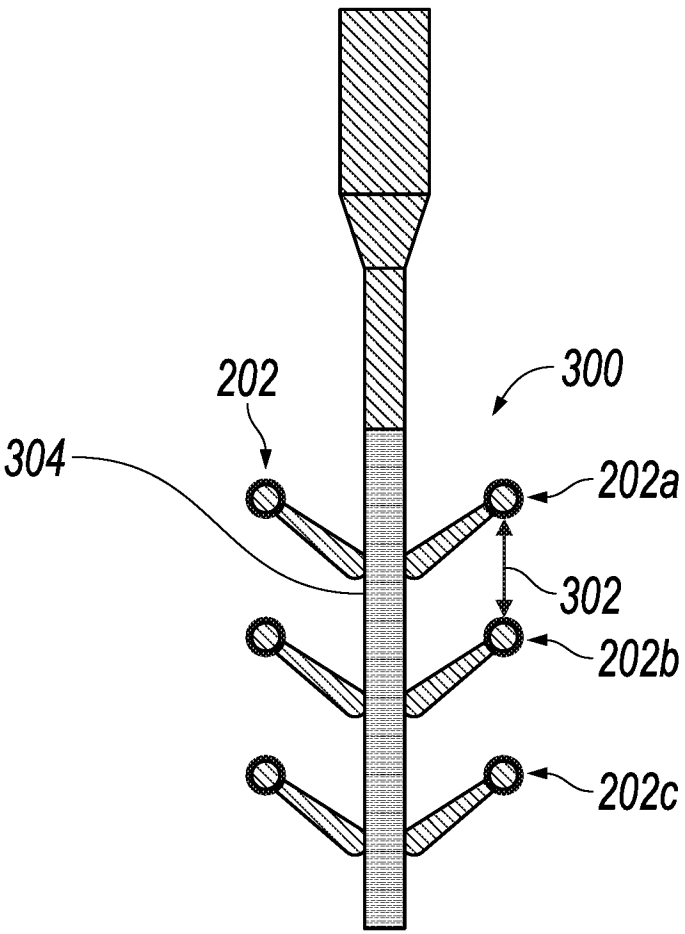
FIG. 3 is a side view of an example wellbore tool with rollers in an extended position.

FIG. 3 is a side view of an example wellbore tool 300 with actuable rollers 202 in an extended position. The wellbore tool 300 is substantially similar to the wellbore tool 200 previously described with the exception of any differences described herein. The wellbore tool 300 includes multiple sets of actuable rollers 202 spaced a distance 302 apart along the longitudinal length of the non-metallic tubular 304. In some implementations, the distance 302 between each set of rollers can be between twenty and fifty feet. Greater or lesser distances can be used depending on the geometry of the wellbore 102 and the non-metallic tubular 304. The multiple actuable rollers 202 can be equidistant apart from each other, or can be different distances from one another. For example, a first set of actuable rollers 202*a* can be a first distance from the second set of rollers 202*b*, while the third set of rollers 202*c* can be a second, different distance from the second set of rollers 202*b*. While three sets of actuable rollers 202 are illustrated, greater or fewer actuable rollers 202 can be used.

Figure 4:
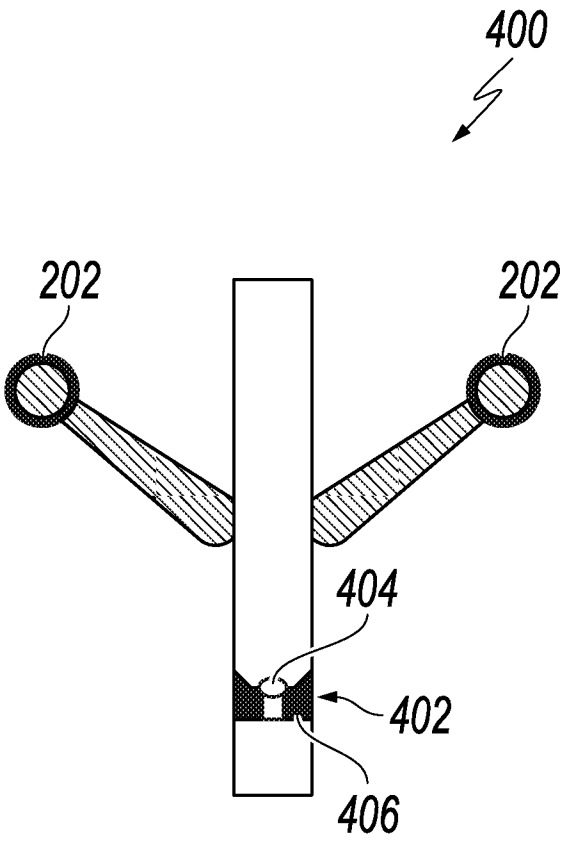
FIG. 4 is a side schematic view of an example actuation mechanism.

FIG. 4 is a side schematic view of an example actuation mechanism 400. As illustrated, the actuator 400 includes a ball seat trigger 402. To actuate the actuable rollers 202 between states, a ball 404 is circulated from the topside facility 106 (FIG. 1), through the metallic work string 108, and into the non-metallic tubular (204 or 304). Within the non-metallic tubular (204 or 304), the ball 404 rests upon a seat 406. In some implementations, the seat 406 can be moved (displaced) by the ball, which can in turn move a linkage (not shown) to transfer motion to the actuable rollers 202. In some implementations, the ball 404 seals against the seat 406 and redirects flow of a fluid flowing through the non-metallic tubular (204 or 304) to a hydraulic system that is moves the actuable rollers 202. In some implementations, a single seat can trigger multiple sets of actuable rollers 202. In some implementations, each set of actuable rollers 202 has its own, separate trigger. In such implementations, each ball seat can have a different diameter configured to receive different diameter balls, allowing each set of actuable rollers 202 to be separately actuated relative to one another.

Figure 5:
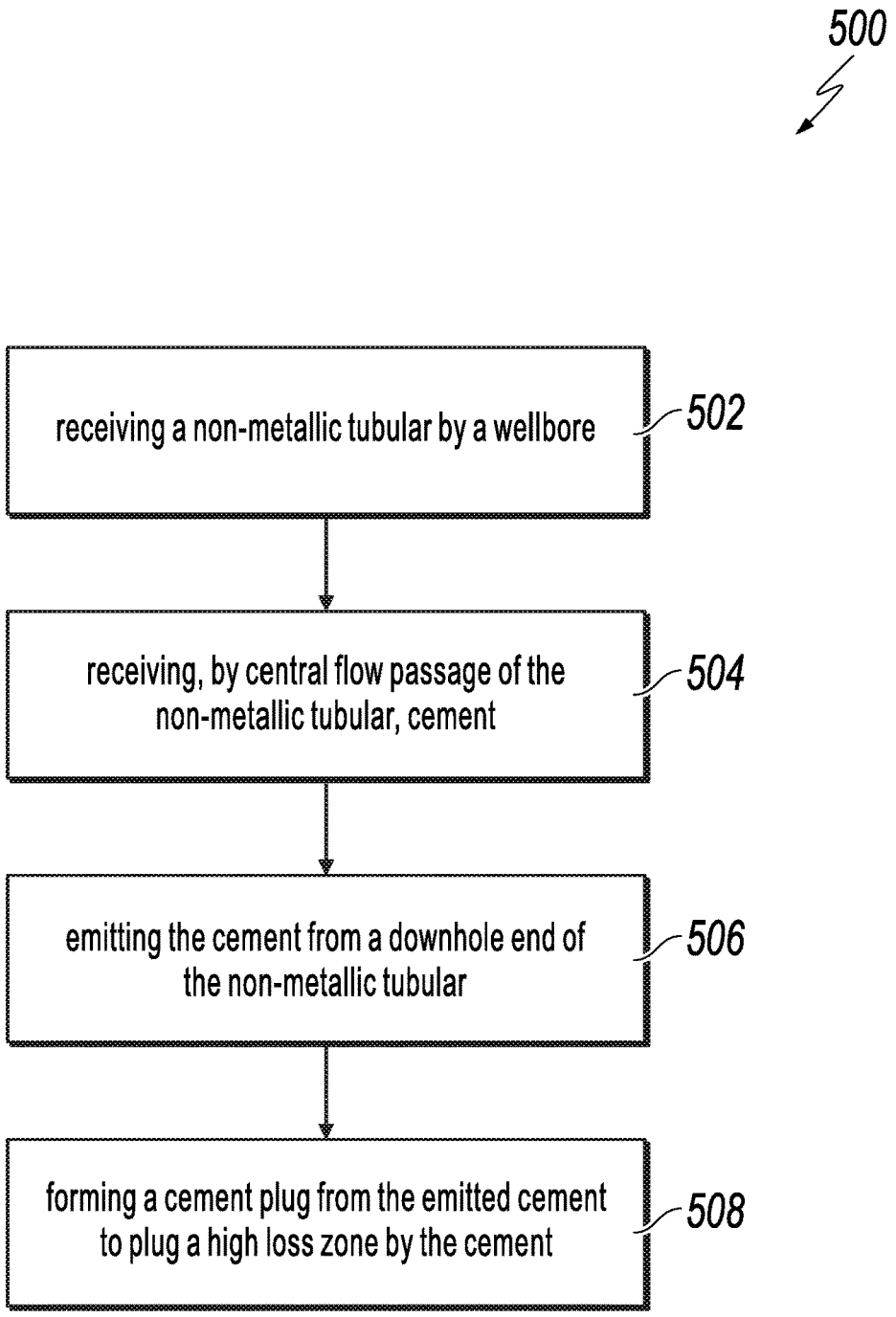
FIG. 5 is a flowchart of an example method that can be used with aspects of this disclosure.

FIG. 5 is a flowchart of an example method 500 that can be used with aspects of this disclosure. At 502, a non-metallic tubular, such as the non-metallic tubular 204 or 304, is received by a wellbore, such as the wellbore 102. When traversing the wellbore, the actuable rollers can be used to centralize the non-metallic tubular. To centralize the non-metallic tubular with the actuable rollers, the actuable rollers are actuated by circulating a ball within the non-metallic tubular. Actuating the actuable rollers involves actuating between an extended position and a retracted position. The actuable rollers centralize the non-metallic tubular when in the extended position.

At 504, cement is received by the central flow passage of the non-metallic tubular. At 506, the cement is emitted from a downhole end of the non-metallic tubular. At 508, a cement plug is formed from the emitted cement to plug a high-loss zone by the cement or to spot a conventional cement plug for any other reason. In some instances, the non-metallic tubular is then removed from the wellbore to allow the cement to cure and form a cement plug. The non-metallic tubular can then be re-used in a different, second wellbore. That is, the non-metallic tubular can be received by the second wellbore. In other words, the non-metallic tubular can be re-used multiple times in multiple different wellbores.

Figure 6B:
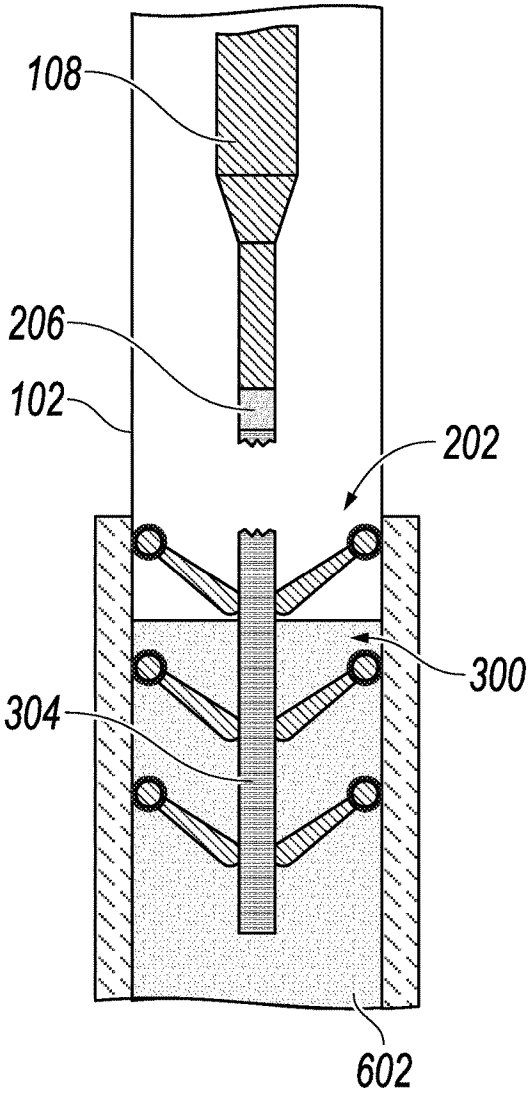
FIGS. 6A-6B are side schematic views of an example non-metallic tubular retained within a cement plug during operations.
Figure 6A:
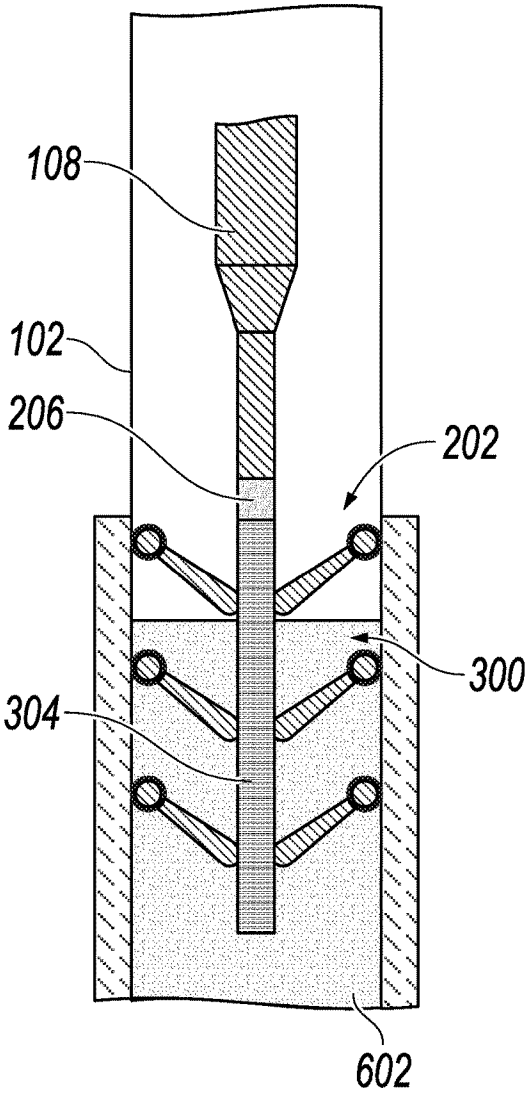

In some instances, during operation, the cement plug flash-sets. That is, the cement sets faster than intended. In such an instance, the non-metallic tubular is retained within the set cement plug. FIGS. 6A-6B are side schematic views of such an instance. While the wellbore tool 300 is illustrated within this example, the concepts described herein are also applicable to wellbore tool 200 (FIG. 2). To remove a retained or "stuck" string, the metallic work-string 108 can either be rotated or pulled. In situations where the metallic work string 108 is rotated, the metallic work string 108, uphole of and attached to the non-metallic tubular 304, is rotated. The rotation torsionally shears either the connector 206 or the non-metallic tubular 204, releasing the non-metallic tubular from the metallic works string 108 (FIG. 6B). In situations where the metallic work string 108 is pulled, then either the connector 206 or the non-metallic tubular mechanically fails. In either situation, the metallic work string 108 is then removed or retracted from the wellbore, leaving the non-metallic tubular within the wellbore 102. Once the metallic work string 108 has been removed from the wellbore, a drill bit drills through both the cement plug 602 and the non-metallic tubular 204 that remain within the wellbore. As the non-metallic tubular 304 is a softer material than a traditional tubular, a standard drill bit can be used.

While this disclosure contains many specific implementation details, these should not be construed as limitations on the scope of any inventions or of what may be claimed, but rather as descriptions of features specific to particular implementations. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described herein should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A wellbore tool comprising:

a non-metallic tubular defining a central flow passage;

actuable rollers actuable between an extended position and a retracted position, the actuable roller pivotally attached to the non-metallic tubular, the actuable rollers centralizing the non-metallic tubular when in the extended position, the actuable rollers extending between the non-metallic tubular to an inner surface of the wellbore when in the extended position;

a connector attached to an uphole end of the non-metallic tubular, the connector configured to attach to a downhole end of a work string; and an actuator to actuate the actuable rollers between the extended position and the retracted position, wherein the actuator comprises a ball seat trigger.

2. The wellbore tool of claim 1, wherein the non-metallic tubular comprises a plastic.

3. The wellbore tool of claim 1, wherein the connector or the non-metallic tubular have a lower yield strength than the work string.

4. A method comprising:

receiving a non-metallic tubular by a wellbore;

receiving, by central flow passage of the non-metallic tubular, cement;

emitting the cement from a downhole end of the non-metallic tubular;

forming a cement plug from the emitted cement to plug a high loss zone by the cement or to spot a conventional cement plug;

rotating a metallic work string uphole of and attached to the non-metallic tubular;

shearing the non-metallic tubular, or a connector retaining the non-metallic tubular to the work string, responsive to rotating the metallic work string;

retracting the metallic work string from the wellbore; and leaving the non-metallic tubular within the wellbore.

5. The method of claim 4, further comprising:

flash-setting the cement plug retaining the non-metallic tubular within the cement plug.

6. The method of claim 4, further comprising drilling through the cement plug and the non-metallic tubular that remains within the wellbore.

7. The method of claim 4, further comprising centralizing the non-metallic tubular by actuable rollers.

8. The method of claim 7, wherein centralizing the non-metallic tubular comprises actuating the actuable rollers by circulating a ball within the non-metallic tubular.

9. The method of claim 8, wherein actuating the actuable rollers comprises actuating between an extended position and a retracted position, the actuable rollers centralizing the non-metallic tubular when in the extended position.

10. A well system comprising;

a metallic work string;

a non-metallic tubular defining a central flow passage, wherein the non-metallic tubular is configured to be removed from the metallic work string by torsional shearing;

actuable rollers actuable between an extended position and a retracted position, the actuable roller pivotally attached to the non-metallic tubular, the actuable rollers extending between the non-metallic tubular to an inner surface of the wellbore when in the extended position; and a connector attached to an uphole end of the non-metallic tubular, the connector configured to attach to a downhole end of the work string.

11. The well system of claim 10, wherein the non-metallic tubular comprises a plastic.

12. The well system of claim 10, wherein the well system further comprises an actuator to actuate the actuable rollers between the extended position and the retracted position.

13. The well system of claim 12, wherein the actuator comprises a ball seat trigger.

14. The well system of claim 10, wherein the non-metallic tubular and the actuable rollers are configured to be drilled out of a wellbore when the non-metallic tubular becomes stuck in a wellbore.

15. The well system of claim 10, wherein the metallic work string comprises coiled tubing.

* * * * *